US008747170B2

(12) United States Patent
Cornelius et al.

(10) Patent No.: US 8,747,170 B2
(45) Date of Patent: Jun. 10, 2014

(54) CONNECTOR ASSEMBLIES AND SYSTEMS AND METHODS FOR FORMING DISCONNECTABLE JOINT ASSEMBLIES

(75) Inventors: Jonathan Conrad Cornelius, Lillington, NC (US); Edward O'Sullivan, Cary, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 55 days.

(21) Appl. No.: 13/565,687

(22) Filed: Aug. 2, 2012

(65) Prior Publication Data

US 2013/0295790 A1 Nov. 7, 2013

Related U.S. Application Data

(60) Provisional application No. 61/641,574, filed on May 2, 2012.

(51) Int. Cl.
*H01R 4/36* (2006.01)

(52) U.S. Cl.
USPC ..... 439/798; 439/810

(58) Field of Classification Search
USPC ..... 439/475, 795–798, 804, 810, 814; 411/383, 384
See application file for complete search history.

(56) References Cited

U.S. PATENT DOCUMENTS 1,539,962 A * 6/1925 Seufert et al. ..... 439/796
2,463,145 A * 3/1949 Buchanan ..... 439/784

(Continued)

FOREIGN PATENT DOCUMENTS

CH 87 834 A 1/1921
EP 1 206 024 A1 5/2002

(Continued)

OTHER PUBLICATIONS

Notification of Transmittal of the International Search Report and the Written Opinion of the International Searching Authority, or the Declaration in corresponding PCT Application No. PCT/US2013/038775 mailed Jul. 12, 2013 (12 pages).

(Continued)

*Primary Examiner* — Thanh Tam Le
(74) *Attorney, Agent, or Firm* — Myers Bigel Sibley & Sajovec, PA

(57) ABSTRACT

A disconnectable joint system includes first and second connectors and a coupling fastener. The first connector defines a first conductor bore to receive a first cable conductor, and a first coupling portion including a first coupling bore and a first integral interlock feature. The second connector defines a second conductor bore to receive a second cable conductor, and a second coupling portion including a second coupling bore and a second integral interlock feature. The first and second coupling portions are mateable in an interlocked position wherein the first and second interlock features are interlocked with one another, the first and second coupling bores are substantially aligned, and the coupling fastener can be inserted through the first and second coupling bores and tightened to securely couple the first and second connectors to one another. The first and second connectors can be separated upon removal of the coupling fastener.

17 Claims, 10 Drawing Sheets

(56) References Cited

U.S. PATENT DOCUMENTS

| | | | | | |
|---|---|---|---|---|---|
| 2,582,384 | A | * | 1/1952 | Knollman | 439/224 |
| 2,901,725 | A | * | 8/1959 | Schuyler | 439/797 |
| 3,408,620 | A | * | 10/1968 | Damiano | 439/797 |
| 4,795,365 | A | * | 1/1989 | Johnston et al. | 439/411 |
| 5,000,705 | A | * | 3/1991 | Kinka et al. | 439/797 |
| 5,035,660 | A | * | 7/1991 | Werner | 439/796 |
| 5,821,463 | A | * | 10/1998 | Ngo | 174/84 C |
| 6,656,000 | B2 | * | 12/2003 | Abdo | 439/797 |
| 6,884,124 | B1 | | 4/2005 | Luzzi | |
| 7,014,514 | B2 | * | 3/2006 | Zahnen | 439/798 |
| 7,249,982 | B1 | | 7/2007 | Craig | |
| 7,717,658 | B2 | | 5/2010 | Peltier | |
| 7,736,187 | B2 | | 6/2010 | Yaworski et al. | |
| 7,858,883 | B2 | | 12/2010 | Seraj et al. | |
| 7,901,243 | B1 | | 3/2011 | Yaworski | |
| 7,918,690 | B2 | | 4/2011 | Yaworski et al. | |
| 8,030,570 | B2 | | 10/2011 | Seraj et al. | |

FOREIGN PATENT DOCUMENTS

| | | | |
|---|---|---|---|
| EP | 1 914 837 | A2 | 4/2008 |
| GB | 2 319 402 | A | 5/1998 |
| GB | 2 421 642 | A | 6/2006 |
| WO | WO 92/11668 | A1 | 7/1992 |

OTHER PUBLICATIONS

"Aluminum ShearBolt Connectors #2 AWG Compact to 1000 kcmil Concentric," 9-1773440-4 E247 (Apr. 2012), Raychem, Tyco Electronics Corporation (2 pages).
"Aluminum ShearBolt Connectors #2 AWG Compact to 1000 kcmil Stranded," TE Connectivity Catalogue Page, (1 page) (Admitted prior art).
"Cable Services," (Oct. 2009), Product Catalogue (11 pages).
"Copper ShearBolt Connectors" Instruction Sheet 408-8894, Feb. 20, 2012, Rev F, Tyco Electronics Corporation (1 page).
"Copper ShearBolt Connectors #2 AWG Compact to 1000 kcmil Concentric," 1654972 E214 (Apr. 2012), Raychem, Tyco Electronics Corporation (2 pages).
"MI6×1.5-6g 17A/F 31.75 Long Brass Multi-Shear Bolt with Recessed End" Tyco Electronics UK Ltd., Rev A, PCN No. CB3871-000, Date: Jul. 13, 2006 (1 page).
"Raychem Smart Limiter Cable Protector," 6-1773448-0 E288 (Apr. 2012), Tyco Electronics Corporation (2 pages).
"Sicon—The First Cable Connector System with Stepless Shear Bolts," (2008) Pfisterer (6 pages).
"ShearBolt Connector, Copper, Solid Oil Stop, 2/0 AWG CPT to 500 kcmil CPT" TE Connectivity, Rev H, Drawing No. 1099861, Date: Dec. 7, 2003 (1 page).
"Wrench-Lok® Grounding Grid Connectors" Instruction Sheet 408-9504, Nov. 22, 1995, Rev A, AMP Incorporated, Harrisburg, PA (2 pages).

* cited by examiner

CONNECTOR ASSEMBLIES AND SYSTEMS AND METHODS FOR FORMING DISCONNECTABLE JOINT ASSEMBLIES

RELATED APPLICATION(S)

The present invention claims the benefit of and priority from U.S. Provisional Patent Application No. 61/641,574, filed May 2, 2012, the disclosure of which is incorporated herein in its entirety.

FIELD OF THE INVENTION

The present invention relates to electrical cables and connections and, more particularly, to connector assemblies for disconnectable joints.

BACKGROUND OF THE INVENTION

Disconnectable joint assemblies are commonly used in electrical power transmission networks in urban environments. Electrical power cables to be spliced are each provided with a cable termination lug or connector. Each cable termination lug is disconnectably and reconnectably secured to the other by a bolt, for example.

Disconnectable joint assemblies as described above are useful in urban network applications where a utility may need the ability to disconnect a joint to sectionalize a piece of cable for repair, for example. By way of example, a bad or damaged cable may be disconnected from the joint assembly to remove the cable from the circuit in a quick and efficient manner, and then reconnected to the joint assembly after the repair is made.

In order to protect the joint, cable, and cable terminal lugs from the environment (e.g., moisture) and to protect technicians from the electrically energized components, joint sleeve systems are employed.

SUMMARY OF THE INVENTION

According to embodiments of the present invention, a disconnectable joint system for disconnectably electrically and mechanically connecting first and second electrical each including a respective electrical conductor includes a first connector, a second connector, and a coupling fastener. The first connector defines a first conductor bore and a first coupling portion. The first conductor bore is configured to receive the conductor of the first cable. The first coupling portion includes a first coupling bore defined therein, and a first integral interlock feature. The second connector defines a second conductor bore and a second coupling portion. The second conductor bore is configured to receive the conductor of the second cable. The second coupling portion includes a second coupling bore defined therein, and a second integral interlock feature. The first and second coupling portions are mateable in an interlocked position wherein the first and second interlock features are interlocked with one another and the first and second coupling bores are substantially aligned. When the first and second coupling portions are in the interlocked position, the coupling fastener can be inserted through the first and second coupling bores and tightened to securely couple the first and second connectors to one another. The first and second connectors can be separated upon removal of the coupling fastener.

According to embodiments of the present invention, a disconnectable joint assembly for disconnectably electrically and mechanically connecting first and second electrical cables each including a respective electrical conductor includes a first connector, a second connector, and a coupling fastener. The first connector defines a first conductor bore and a first coupling portion. The first conductor bore is configured to receive the conductor of the first cable. The first coupling portion includes a first coupling bore defined therein, and a first integral interlock feature. The second connector defines a second conductor bore and a second coupling portion. The second conductor bore is configured to receive the conductor of the second cable. The second coupling portion includes a second coupling bore defined therein, and a second integral interlock feature. The first and second coupling portions are mated in an interlocked position wherein the first and second interlock features are interlocked with one another and the first and second coupling bores are substantially aligned. The coupling fastener extends through the first and second coupling bores and securely couples the first and second connectors to one another. The first and second connectors can be separated upon removal of the coupling fastener.

According to method embodiments of the present invention, a method for disconnectably electrically and mechanically connecting first and second electrical cables each including a respective electrical conductor includes providing a disconnectable joint assembly including a first connector, a second connector, and a coupling fastener. The first connector defines a first conductor bore and a first coupling portion. The first conductor bore is configured to receive the conductor of the first cable. The first coupling portion includes a first coupling bore defined therein, and a first integral interlock feature. The second connector defines a second conductor bore and a second coupling portion. The second conductor bore is configured to receive the conductor of the second cable. The second coupling portion includes a second coupling bore defined therein, and a second integral interlock feature. The method further includes: mating the first and second coupling portions in an interlocked position wherein the first and second interlock features are interlocked with one another and the first and second coupling bores are substantially aligned; and with the first and second coupling portions in the interlocked position, inserting the coupling fastener through the first and second coupling bores and tightening the coupling fastener to securely couple the first and second connectors to one another.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
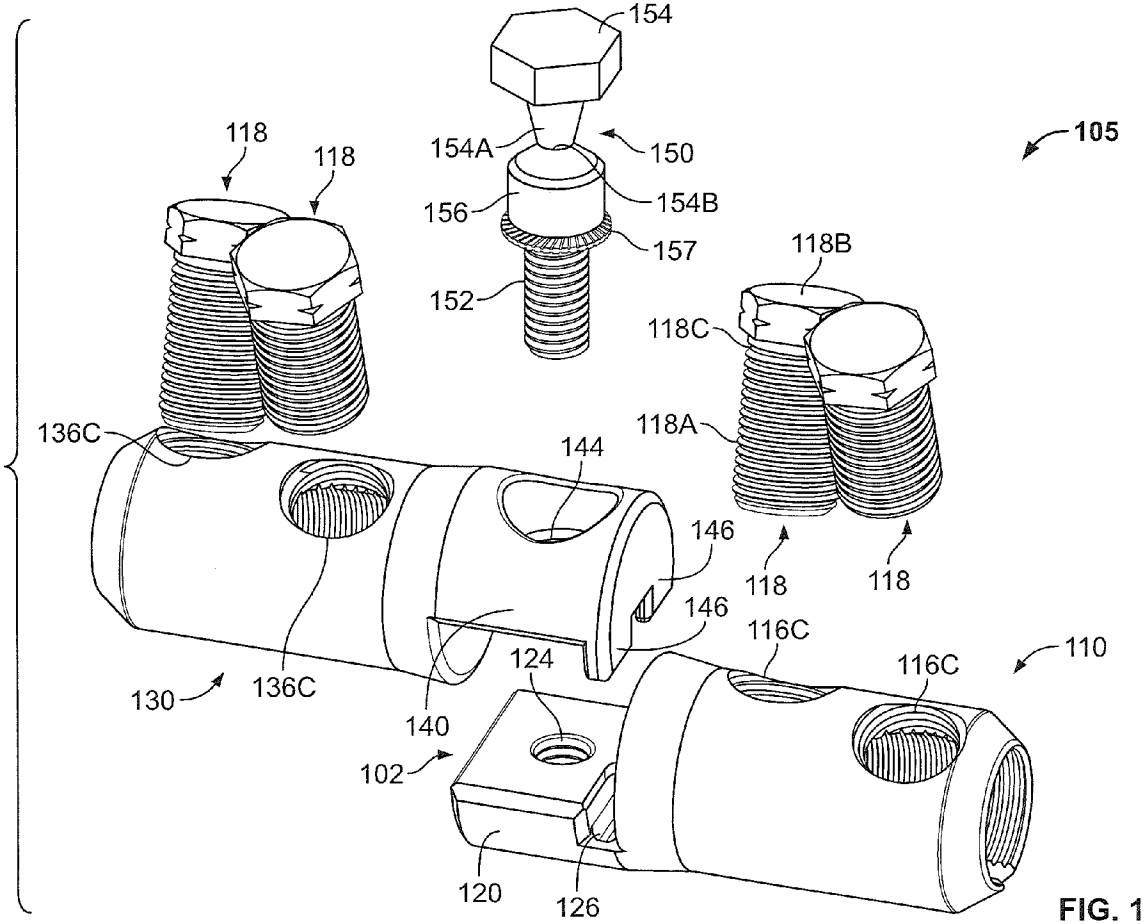
FIGS. 1 and 2 are exploded, perspective views of a disconnectable joint system according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

As used herein, "monolithic" means an object that is a single, unitary piece formed or composed of a material without joints or seams.

As used herein, "cold-applied" or "cold-applied cover" means that the cover or component can be assembled or installed about a substrate (e.g., a cable) without requiring the use of applied heat at the time of installation.

As used herein, "cold shrink" or "cold shrink cover" means that the cover or component can be shrunk or contracted about a substrate (e.g., a cable) without requiring the use of applied heat.

With reference to FIGS. 1-8, a disconnectable joint system 105 according to some embodiments of the present invention is shown therein. The system 105 can be used to construct a disconnectable joint assembly 100 (hereinafter, "the joint assembly 100") according to some embodiments of the present invention. The joint assembly 100 can be used to form a mechanical and electrical connection or joint 10 between two power cables 40, 50, for example. In some embodiments, the connection 10 is provided with a cover or cover assembly 170 to form an environmentally protected connection.

The system 105 includes a first connector 110, a second connector 130, and a coupling fastener 150. According to some embodiments and as shown, the coupling fastener 150 is a threaded fastener and, in some embodiments, is a bolt. The connectors 110, 130 incorporate an integral alignment and interlock system 102 as discussed below. The connectors 110, 130 are adapted and configured to provide mechanical and electrical connections between each connector 110, 130 and a respective cable 40, 50 and between each other, as discussed hereinbelow.

According to some embodiments and as illustrated, the first connector 110 (FIG. 5) is a shear bolt connector including an electrically conductive (e.g., metal) connector body 112 and one or more (as shown, two) clamp threaded fasteners or bolts 118. The connector body 112 has axially opposed ends 112A and 112B defining a connector axis A-A. The connector body 112 includes a cable or main portion 114 and a coupling portion, tab, arm or lug 120 extending to the end 112B, A conductor bore 116A is defined in the main portion 114, communicates with a cable receiving opening 116B on the end 112A, and extends generally coaxially with the axis A-A. Threaded bolt bores 116C extend radially through the main portion 114 and intersect the conductor bore 116A. The conductor bore 116A is configured to receive a terminal segment of the cable conductor 40. The main portion 114 has an end face 114B and a generally cylindrical outer surface 114A.

Each conductor clamp bolt 118 includes a shank 118A, a head 118B, and a shear region or section 118C. The head 118B is configured to operatively engage a driver tool. The shank 118A has an external thread complementary to the thread of the bores 116C. The heads 118B on the bolts 118 are configured to shear off of a remainder of the associated bolt 118 (i.e., the threaded shank) at the region 118C when subjected to a prescribed torque.

The coupling lug 120 extends axially from the lower part of the main portion 114 from the end face 114B. The coupling lug 120 has a planar inner face 122A, an end face 122B, and a semi-cylindrical outer surface 122C. A threaded coupling bore 124 extends radially through the coupling lug 120 from the inner face 122A to the outer surface 122C.

The coupling lug 122 has alignment and interlock features defined therein in the form of two, side-by-side interlock slots 126 extending into the inner face 122A and defining a partition wall 127 therebetween. The interlock slots 126 extend transversely to the connector axis A-A. The interlock slots 126 may be formed by machining, molding, or casting, for example.

The second connector 130 (FIG. 6) includes a connector body 132 and clamp bolts 118 (mounted in threaded bores 136C) corresponding to and constructed in the same manner as the connector body 112 and the clamp bolts 118. The second connector 130 has a connector axis B-B and a conductor bore 136A generally coaxial therewith. The second connector 130 further includes a coupling portion, tab, arm, or lug 140 extending axially from the upper part of the main portion 134 and beyond the end face 134B. The coupling lug 140 has a planar inner face 142A, an end face 142B, and a semi-cylindrical outer surface 142C. A nonthreaded coupling bore 144 extends radially through the coupling lug 140 from the inner face 142A to the outer surface 142C.

The coupling lug 140 has alignment and interlock features defined therein in the form of two, side-by-side interlock projections, tabs or posts 146 extending radially inwardly from the inner face 142A and defining a gap slot 147 therebetween. The interlock posts 146 extend transversely to the connector axis B-B. The interlock posts 146 may be formed by machining, molding, or casting, for example.

The coupling bolt 150 includes a shank 152, an upper head 154, a lower head 156 joined to the head 154 by a neck 154A, and a shear region or section 154B proximate the interface joint between the neck 154A and the lower head 156. The head 154 is configured to operatively engage a driver tool. The shank 152 has an external thread complementary to the thread of the coupling bore 124. The head 154 and neck 154A are configured to shear off of a remainder of the bolt 150 (i.e., the head 156 and the threaded shank 152) at the shear section 154B when the head 154 is subjected to a prescribed torque. The coupling bolt 150 may be formed by machining, molding, or casting, for example.

According to some embodiments, the connector bodies 112, 132 are formed of steel, copper, brass or aluminum. According to some embodiments, the clamp bolts are 118 are formed of copper, brass or aluminum. According to some embodiments, the coupling bolt 150 is formed of copper, brass or aluminum.

Figure 7:
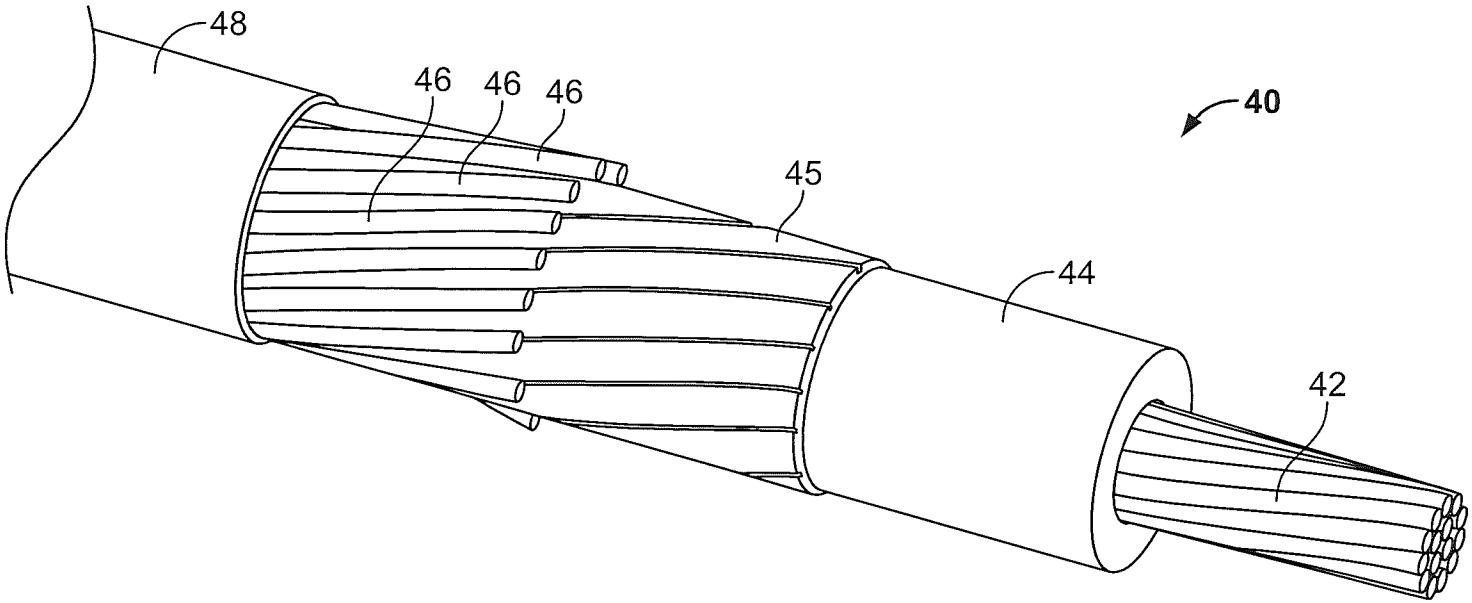
FIG. 7 is a perspective view of an exemplary electrical cable for use with the joint assembly of FIG. 3.

As shown in FIG. 7, the cable 40 includes a primary electrical conductor 42, a polymeric insulation layer 44, a semiconductor layer 45, one or more neutral conductors 46, and a jacket 48, with each component being concentrically surrounded by the next. According to some embodiments and as shown, the neutral conductors 46 are individual wires, which may be helically wound about the semiconductor layer 45; however, metal tape shielding or the like may be used instead. The primary conductor 42 may be formed of any suitable electrically conductive materials such as copper (solid or stranded). The polymeric insulation layer 44 may be formed of any suitable electrically insulative material such as crosslinked polyethylene (XLPE) or ethylene propylene rubber (EPR). The semiconductor layer 45 may be formed of any suitable semiconductor material such as carbon black with polyethylene. The neutral conductors 46 may be formed of any suitable material such as copper. The jacket 48 may be formed of any suitable material such as EPDM. The cable 50 (FIG. 8) is similarly constructed with a primary electrical conductor 52, a polymeric insulation layer 54, a semiconductor layer 55, one or more neutral conductors 56, and a jacket 58 corresponding to components 42, 44, 45, 46 and 48, respectively. According to some embodiments, the cables 40, 50 are low-voltage or medium-voltage (e.g., between about 5 and 46 kV) power transmission cables. The cables 40, 50 are exemplary and it will be appreciated that connector assemblies as disclosed herein can be used with other types of cables.

The disconnectable joint system 105 can be used and installed on the cables 40, 50 as follows to form the joint 10.

The cables 40, 50 are prepared as shown in FIG. 7 such that a terminal segment of each cable layer extends beyond the next overlying layer.

The end of the cable conductor 42 is inserted through the opening 116B into the conductor bore 116A. The shear bolts 118 of the connector 110 are rotated and torqued using a suitable driver (e.g., an electrically insulated powered or non-powered driver including a drive socket N to operatively receive and engage the heads of the bolts 118, 150) until the heads 118B thereof shear or break off of the shanks 118A at a prescribed load. The conductor 42 is thereby electrically connected to the connector 110 and mechanically clamped in the bore 116A, and the remaining portions of the bolts 118 are flush or approximately flush with the outer surface 114A of the connector 110. The cable conductor 52 is likewise inserted through the opening 136B and secured in the conductor bore 136A of the connector 130 using the shear bolts 118.

Figure 4:
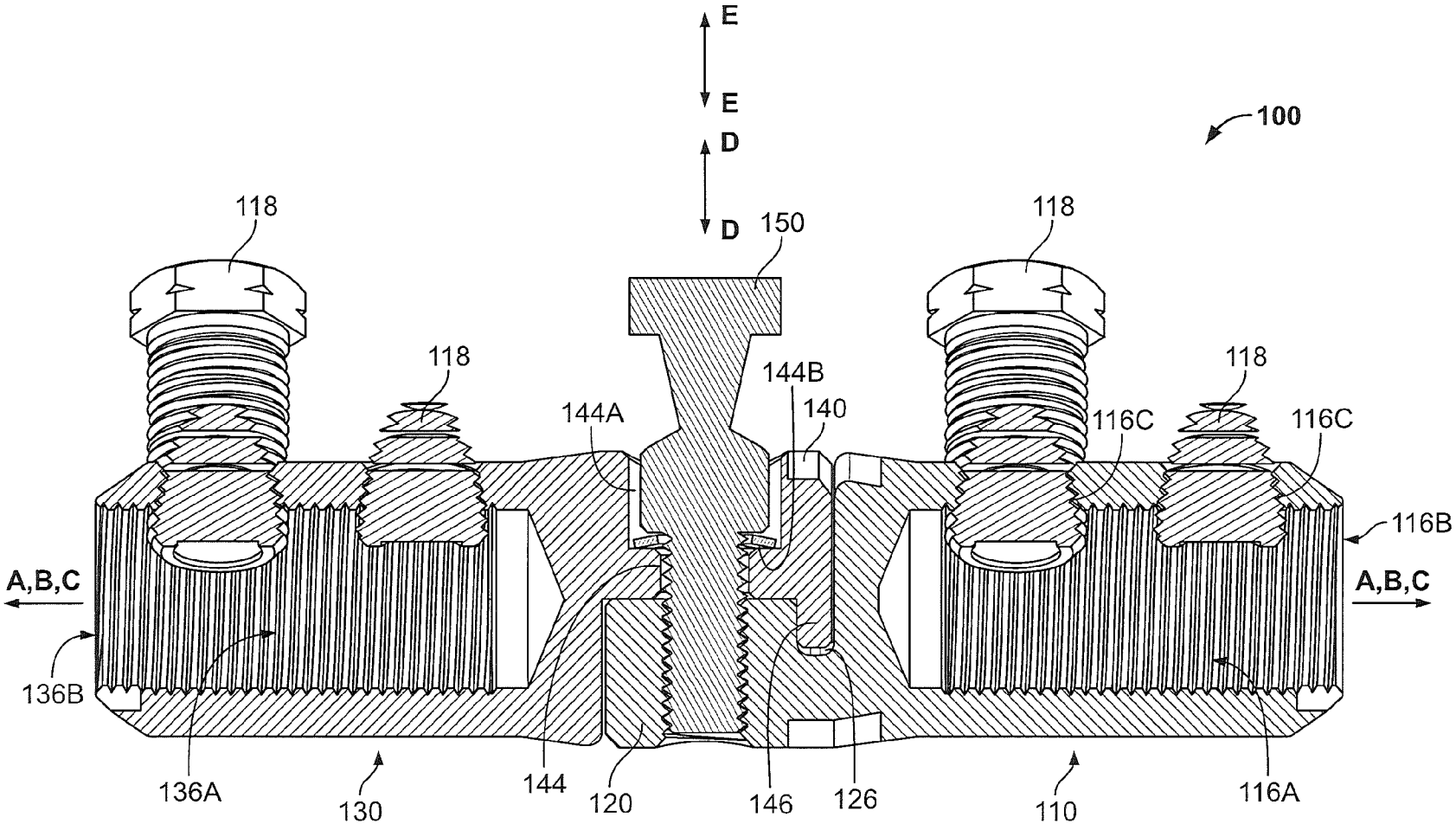
FIG. 4 is a cross-sectional view of the joint assembly of FIG. 3 taken along the lines 4-4 of FIG. 3.
Figure 5:
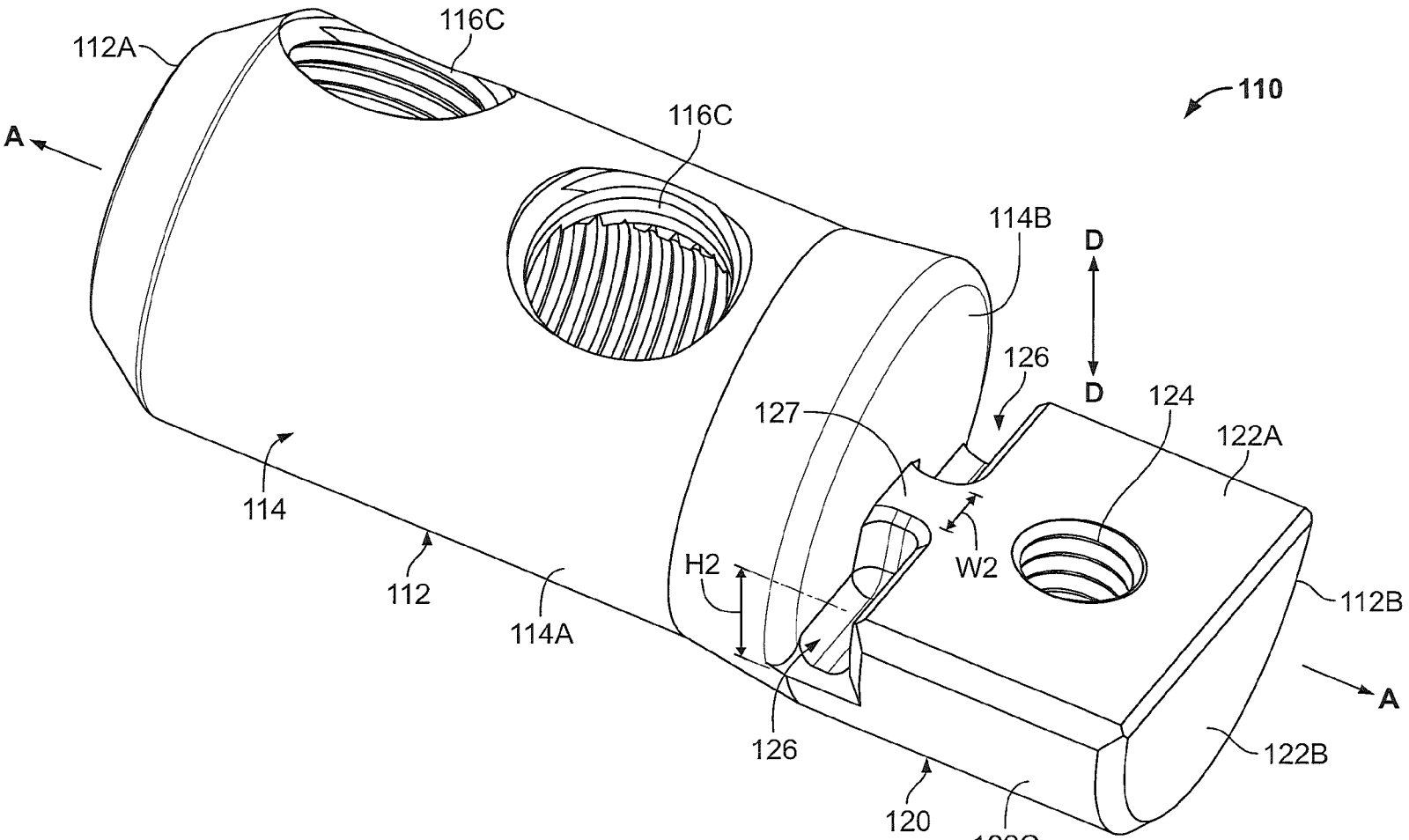
FIG. 5 is a perspective view of a first connector forming a part of the joint assembly of FIG. 3.
Figure 6:
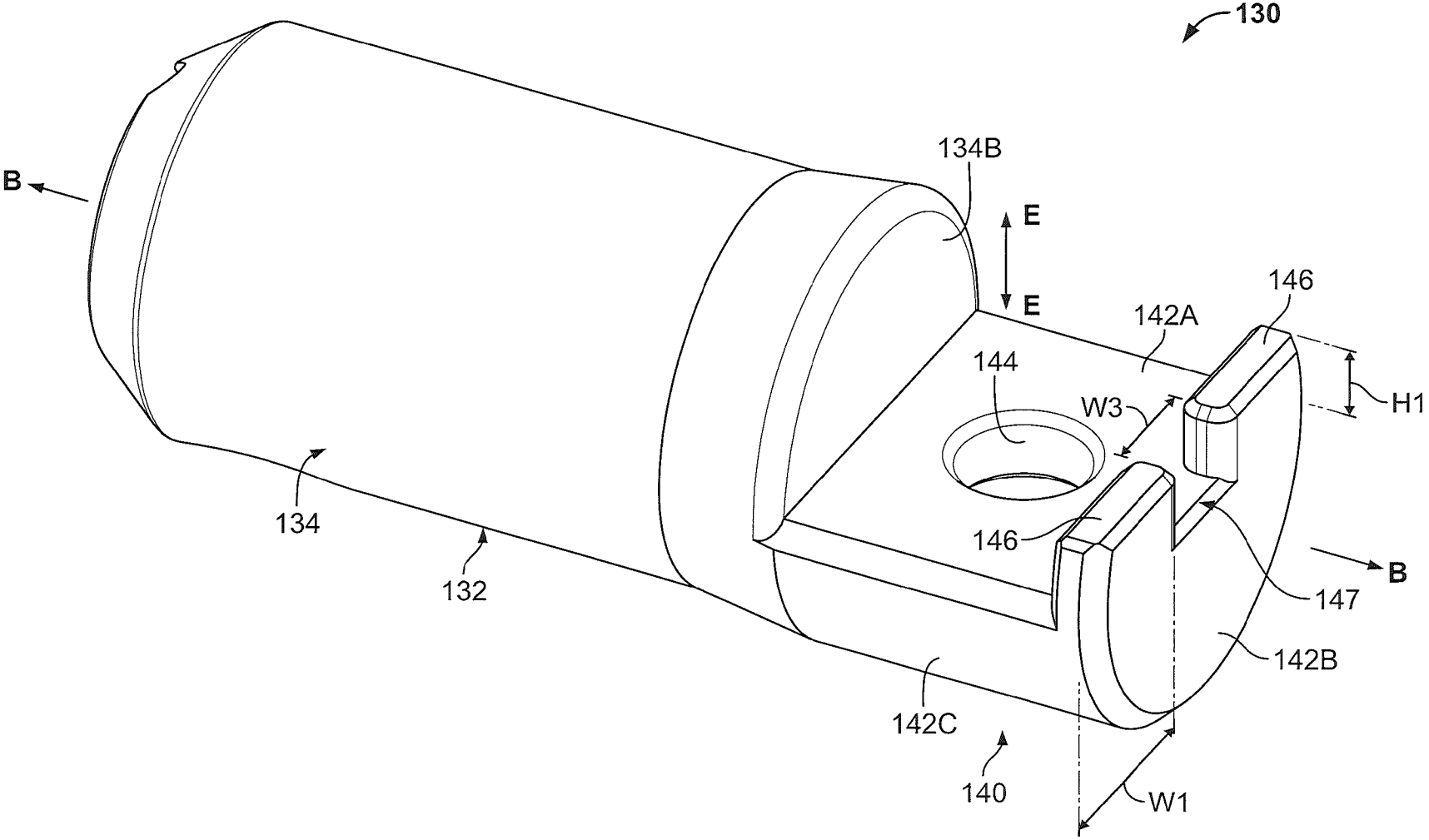
FIG. 6 is a perspective view of a second connector forming a part of the joint assembly of FIG. 3.

The connectors 110 and 130 are then preliminarily mated or joined in an interlocked position. More particularly, the connectors 110, 130 are relatively positioned such that the interlock posts 146 and the interlock slots 126 (which collectively form the alignment and interlock system 102) are generally laterally aligned with one another (i.e., are generally positioned at the same location along a joint lengthwise axis C-C (FIG. 4). The connectors 110, 130 are then relatively moved laterally together in a lateral mating or insertion direction I (FIG. 2) along a first lateral axis J-J (FIG. 2) so that the posts 146 are received in the slots 126, the partition wall 127 is received in the gap slot 147, and the inner faces 122A, 142A are in abutment or close proximity. In this position, the coupling lug end face 142B is in abutment with or close proximity to the main portion end face 114B, the end face 122B is in abutment with or close proximity to the main portion end face 134B, and the axis D-D of the coupling bore 124 is substantially aligned with the axis E-E of the coupling bore 144 as shown in FIG. 4.

Even in the absence of the coupling bolt 150, the interlock between the posts 146 and the slots 126 serves to retain the connectors 110, 130 in their relative positions along the joint axis C-C. As long as the coupling lugs 120, 140 are prevented (e.g., by the installer's hand) from laterally separating along the axis J-J to an extent sufficient to remove the posts 146 from the slots 126, the interlock between the posts 146 and the slots 126 will prevent the connectors 110, 130 from being axially separated (e.g., by a divergent axial pull force or forces $F_A$ (FIG. 8) applied to or by the cables 40, 50). The interlocking features 126, 146 can thereby provide temporary strain relief.

Figure 2:
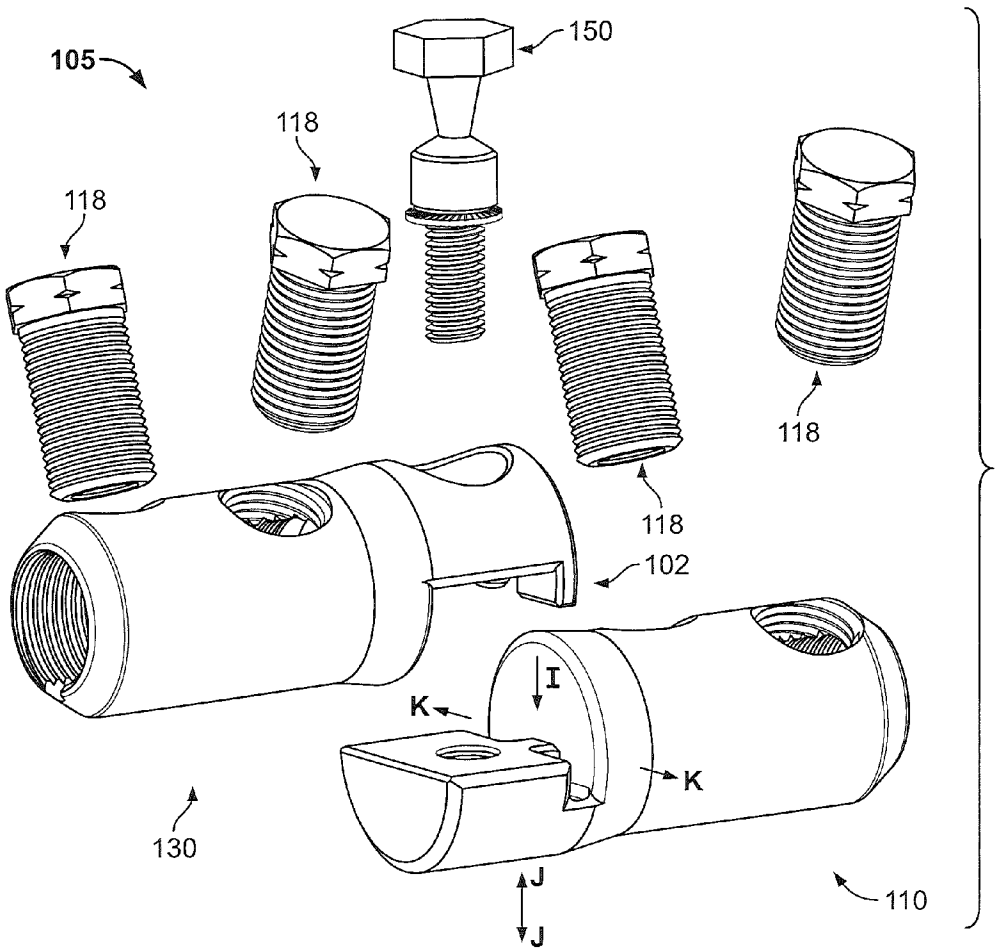
Figure 3:
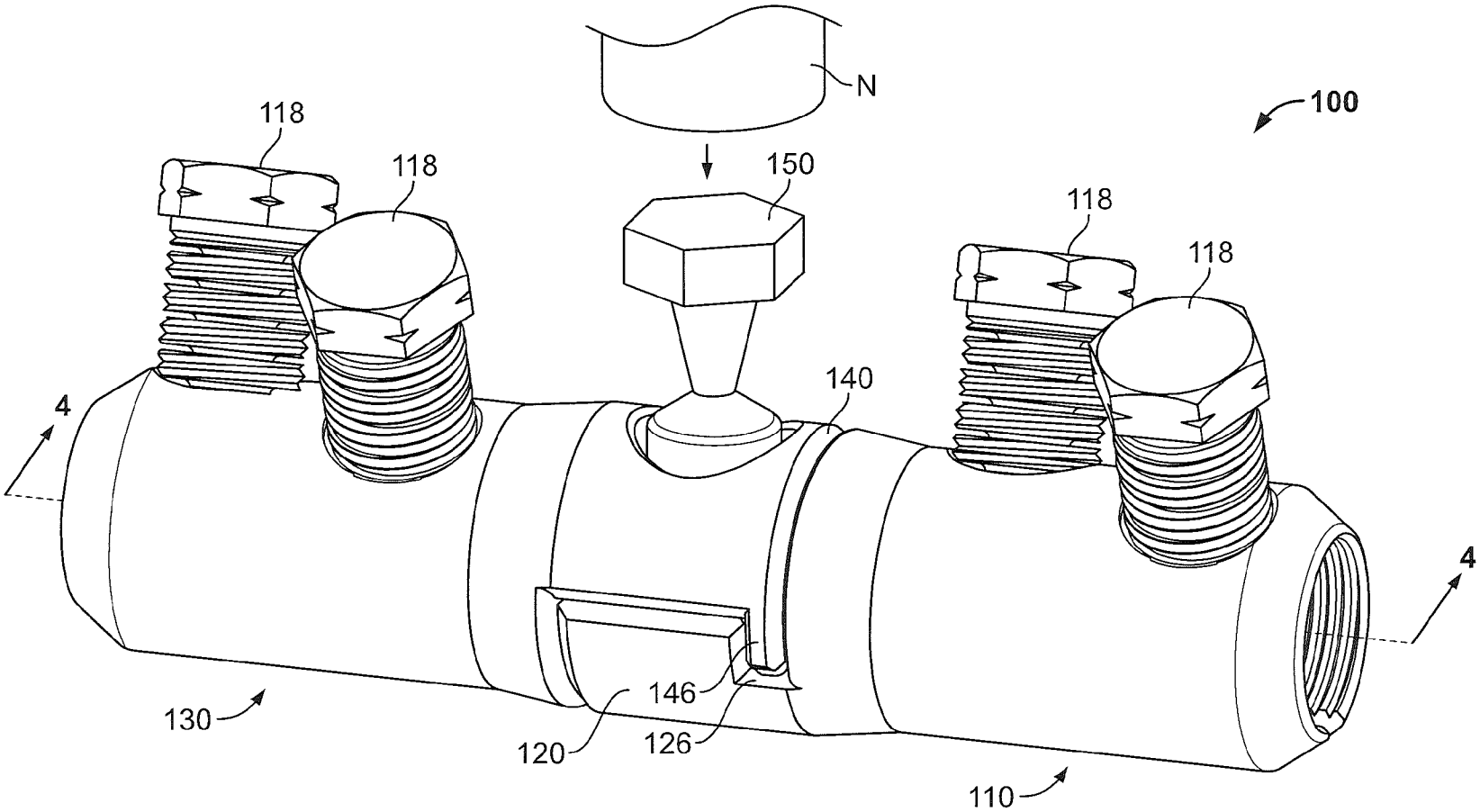
FIG. 3 is a perspective view of a disconnectable joint assembly according to embodiments of the present invention and assembled using the joint system of FIG. 1.

The interlock between the partition wall 127 and the gap slot 147 prevents the coupling lugs 120 140 from being relatively displaced (e.g., translated) along a lateral or sideward axis K-K (FIG. 2). The planar, complementary shapes of the inner faces 122A, 142A as well as the cooperating geometries of the features 126, 146 can resist or prevent the coupling lugs 120, 140 from being twisted or rotated about the joint axis C-C so long as the inner faces 122A, 142A are held in abutment. The positive interlocking engagement as described above can thus ensure that the axes D-D, E-E of the coupling bores 124, 144 are maintained in alignment to facilitate insertion of the coupling bolt 150.

With the coupling lugs 120, 140 mated and aligned as described above, the coupling bolt 150 is inserted through the coupling bore 144 and threaded into the coupling bore 124. The head 154 is engaged with a suitable driver N and rotated and torqued until the head 154 and neck 154A shear or break off at the shear region 154B upon application of a prescribed load. As the bolt 150 is torqued, the lower head 156 seats in the counterbore or head bore 144A and bears against the shoulder 144B to apply a clamping load to the coupling lugs 120, 140. The joint 10 and the joint assembly 100 are thereby completed.

Figure 8:
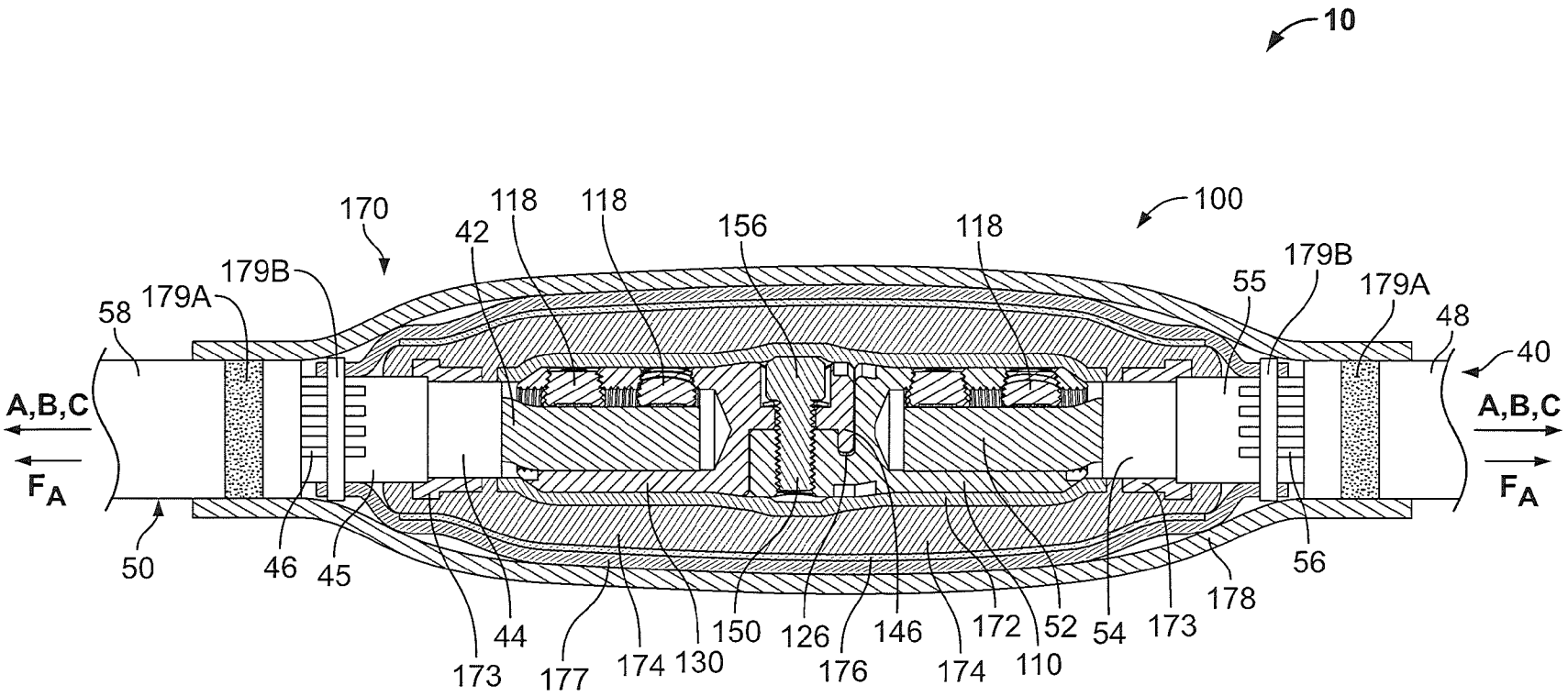
FIG. 8 is a cross-sectional view of a covered connection including the joint assembly of FIG. 3.

With reference to FIG. 8, it can be seen that, according to some embodiments, the shear bolts 118, 150 once installed are nearly or approximately flush with the outer surfaces or profile of the connectors 110, 130. In this way, the joint assembly 100 can present a generally smooth, regular outer profile with no or relatively few sharp edges or transitions. Such a geometry may be particularly beneficial when the joint assembly 100 is further covered by a cold-shrink or heat-shrinkable cover, as discussed below.

According to some embodiments and as reflected in the illustrative embodiment, the outer surfaces 122C, 142C of the coupling lugs 120, 140 collectively form a substantially cylindrical outer surface or profile that smoothly transitions to the outer profiles of the adjacent main portions 114, 134.

When desired, the connectorized cables 40, 50 can be disconnected from one another, without removing the connectors 110, 130 from the cables 40, 50, by removing the coupling bolt 150 and disconnecting the connectors 110, 130. The coupling bolt 150 may be removed by drilling and driving the bolt 150 out using an "easy out" tool, for example. The cables 40, 50 may be disconnected in this manner in order to test one or both of the cables 40, 50 or an assembly attached to one of the cables 40, 50.

The connectors 110, 130 can thereafter be reconnected in the same manner as described above using a new coupling bolt 150 to re-form the joint 10.

According to some embodiments, the height H1 (FIG. 6) of each post 146 is in the range of from about 0.03 to 0.25 inch. According to some embodiments, the width W1 (FIG. 6) of each post 146 is in the range of from about 0.125 to 0.5 inch. According to some embodiments, the width W2 (FIG. 5) of the partition wall 127 is in the range of from about 0.06 to 0.25 inch. According to some embodiments, the depth H2 (FIG. 5) of each slot 126 is between about 0.04 and 0.26 inch greater than the height H1 of the received post 146. According to some embodiments, the width W3 (FIG. 6) of the gap slot 147 is between about 0.07 and 0.26 inch greater than the width W2 of the partition wall 127.

According to some embodiments, the planar inner faces 122A, 142A extend across the full diameter or width of the connector body 112, 132.

According to some embodiments, the joint 10 (including the joint assembly 100) is covered by the cover assembly 170 to electrically insulate and cover the joint 10 as shown in FIG. 8. The cover assembly 170 may be provided as a pre-expanded unit including a holdout device on which the cover assembly 170 or some components thereof are mounted in an expanded state or position. The cover assembly 170 may be deployed and mounted on the intended substrates in a retracted state or position as shown in FIG. 8. According to some embodiments, the cover assembly 170 is a cold shrink cover, meaning that it can be shrunk or retracted about the substrate without requiring the use of applied heat.

The cover assembly 170 includes a Faraday cage layer 172, stress cone layers 173, an inner sleeve (or insulation body) 174, a semiconductor layer 175, a metal shield mesh layer 177, and an outer sleeve (or re-jacket) 178. Sealant 179A (e.g., mastic) may be provided to seal the outer sleeve 178. Clamps 179B or the like may be provided to secure the mesh layer 177 and cable neutrals 46, 56.

The inner sleeve 174 is tubular and defines an axially extending conductor through passage that communicates with opposed end openings.

The Faraday cage layer 172 is illustrated as a generally tubular sleeve bonded to the inner surface of the inner sleeve 174. The Faraday cage layer 172 may be formed of a suitable elastically conductive elastomer. In use, the Faraday cage layer 172 may form a Faraday cage to provide an equal potential volume about the connector assembly 100 so that an electric field is cancelled in the surrounding air voids.

The stress cone layers 173 are illustrated as generally tubular sleeves bonded to the inner surface of the inner sleeve 174 at either end thereof. The stress cone layers 173 may be formed of a suitable electrically conductive elastomer. In use, the stress cone layers 173 may serve to redistribute the voltage along the surface of the cable insulation 44, 54 to reduce or prevent the degradation of the insulation 44, 54 that might otherwise occur.

The semiconductor layer 176 fully circumferentially surrounds the inner sleeve 174. According to some embodiments, the semiconductor layer 176 is coextensive with the inner sleeve 174.

The shield mesh layer 177 fully circumferentially surrounds the inner sleeve 174. According to some embodiments, the shield mesh layer 177 includes opposed end sections that extend beyond the ends of the inner sleeve 174 but do not extend as far out as the outer sleeve 178. The shield mesh layer 177 may be formed of braided or woven copper filaments, for example.

The outer sleeve 178 fully circumferentially surrounds the shield mesh layer 177. The outer sleeve 178 is tubular and defines an axially extending conductor through passage that communicates with opposed end openings.

The semiconductor layer 176 can be formed of any suitable electrically semiconductive material. According to some embodiments, the semiconductor layer 176 is formed of an elastically expandable material. According to some embodiments, the semiconductor layer 176 is formed of an elastomeric material. According to some embodiments, the semiconductor layer 176 is formed of carbon black and silicone. Other suitable materials may include carbon black and EPDM.

The inner sleeve 174 can be formed of any suitable material. According to some embodiments, the inner sleeve 174 is formed of a dielectric or electrically insulative material. According to some embodiments, the inner sleeve 174 is formed of an elastically expandable material. According to some embodiments, the inner sleeve 174 is formed of an elastomeric material. According to some embodiments, the inner sleeve 174 is formed of liquid silicone rubber (LSR). Other suitable materials may include EPDM or ethylene propylene rubber (EPR). According to some embodiments, the inner sleeve 174 has a Modulus at 100 percent elongation (M100) in the range of from about 0.4 to 0.52 MPa.

According to some embodiments, the thickness of the inner sleeve 174 is in the range from about 0.07 to 2 inches. According to some embodiments, the length of the inner sleeve 174 is in the range from about 8 to 30 inches.

The outer sleeve 178 can be formed of any suitable material. According to some embodiments, the outer sleeve 178 is formed of an electrically insulative material. According to some embodiments, the outer sleeve 178 is formed of an elastically expandable material. According to some embodiments, the outer sleeve 178 is formed of an elastomeric material. According to some embodiments, the outer sleeve 178 is formed of ethylene propylene diene monomer (EPDM) rubber. Other suitable materials may include neoprene or other rubber. According to some embodiments, the outer sleeve 178 has a Modulus at 100 percent elongation (M100) in the range of from about 0.6 to 1.1 MPa.

According to some embodiments, the thickness of the outer sleeve 178 is in the range of from about 0.11 to 0.25 inch. According to some embodiments, the length of the outer sleeve 178 is in the range of from about 15 to 35 inches.

While a multi-component cold-shrink, cold-applied cover assembly is described above and shown in FIG. 8, other types and configurations of covers and cover assemblies may be used. For example, a heat-shrinkable cover or cover assembly may be applied about the joint assembly 100. The joint assembly 100 may be covered with more or fewer components (e.g., covered only by an insulating re jacket sleeve).

Figure 9:
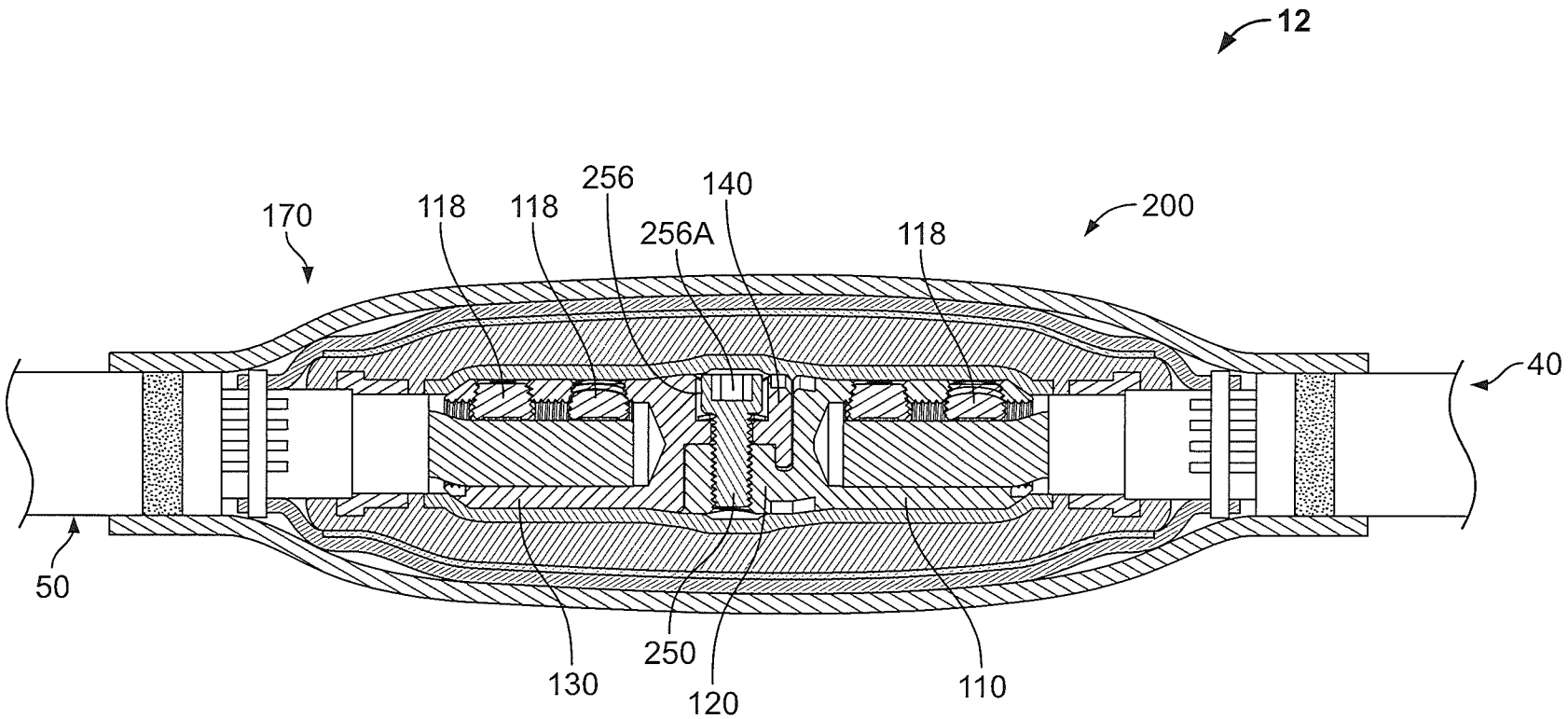
FIG. 9 is a cross-sectional view of a covered connection including a disconnectable joint assembly according to further embodiments of the present invention.

With reference to FIG. 9, a connection 12 including a disconnectable joint assembly 200 according to further embodiments of the present invention is shown therein. The joint assembly 200 is covered by the cover assembly 170. The joint assembly 200 corresponds to and is constructed and can be installed in the same manner as the joint assembly 100 except that the coupling bolt 150 is replaced with a non-shear threaded coupling fastener or bolt 250. The coupling bolt 250 includes a head 256 having a tool receptor or socket 256A (e.g., a hex socket) defined therein to receive a driver. The coupling bolt 250 may be, for example, a cap screw having a hex socket. In use, the coupling bolt 250 can be driven via the socket 256A to tighten the coupling bolt 250 to clamp the coupling lugs 120, 140, and can also be driven via the socket 256A to remove the bolt 150. Other types and configurations of coupling fasteners may be used as well.

According to some embodiments, the coupling bolt 150 may be replaced with a shear bolt having a feature that remains (after the head has sheared off) to enable operative engagement with a driver to remove the bolt.

Figure 10:
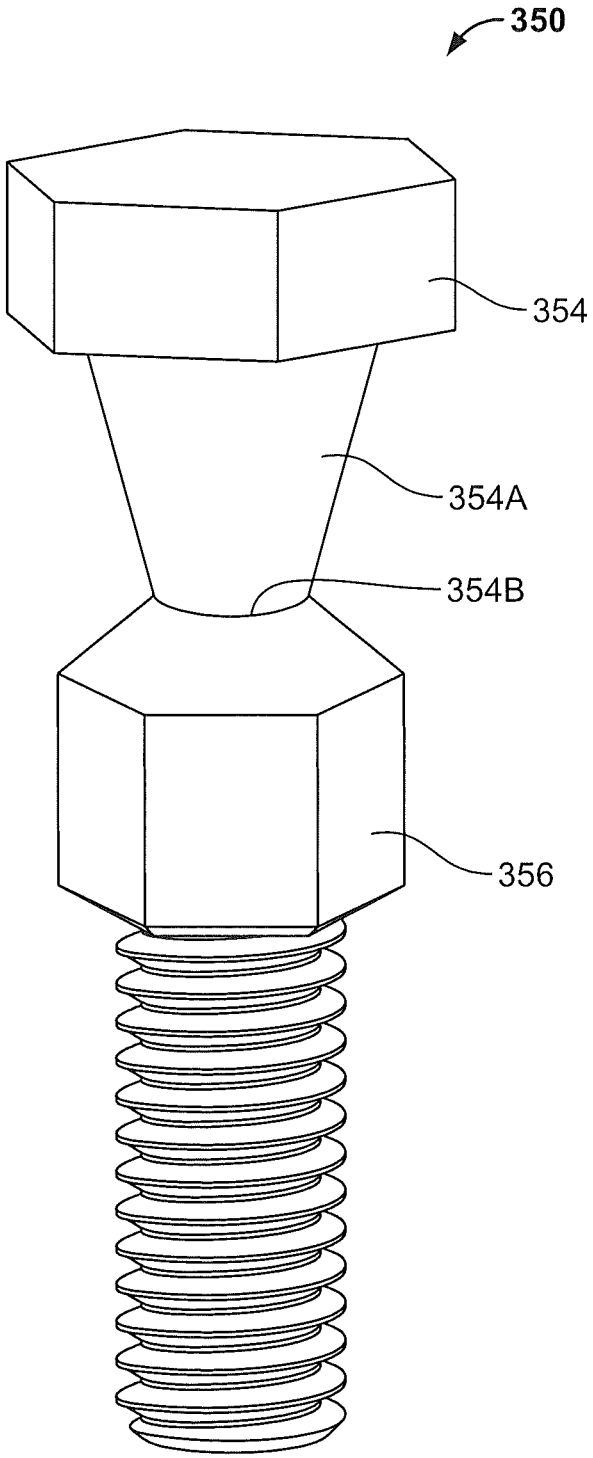
FIG. 10 is a perspective view of an alternative coupling bolt for use in the joint assembly of FIG. 3.

For example, with reference to FIG. 10, an alternative coupling threaded fastener or bolt 350 is shown therein that can be used in place of the coupling bolt 150 in accordance with some embodiments of the invention. The coupling bolt 350 is a shear bolt constructed and usable in the same manner as the coupling bolt 150 except that the lower head 356 is configured or shaped to engage a driver. For example, as illustrated, the lower head 356 can be a hex-shaped head configured to be received in a complementary hex-shaped socket of a driver. According to some embodiments, the lower head 356 is sized (e.g., small enough in diameter) to provide clearance to permit the driver to fit down in the counterbore 144A (FIG. 4) about the lower head 356. In use, the lower head 356 can be used, after the neck 354A and head 354 have been sheared off at a shear plane or section 354B, to drive (using the driver) the coupling bolt 350 out of the connector bore 124 to disconnect the connectors 110, 130.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A disconnectable joint system for disconnectably electrically and mechanically connecting first and second electrical cables each including a respective electrical conductor, the disconnectable joint system comprising:

a first connector defining a first conductor bore and a first coupling portion, the first conductor bore configured to receive the conductor of the first cable, the first coupling portion including:

a first coupling bore defined therein; and a first integral interlock feature;

a second connector defining a second conductor bore and a second coupling portion, the second conductor bore configured to receive the conductor of the second cable, the second coupling portion including:

a second coupling bore defined therein; and a second integral interlock feature; and a coupling fastener;

wherein:

the first and second coupling portions are mateable in an interlocked position wherein the first and second interlock features are interlocked with one another and the first and second coupling bores are substantially aligned;

when the first and second coupling portions are in the interlocked position, the coupling fastener can be inserted through the first and second coupling bores and tightened to securely couple the first and second connectors to one another;

the first and second connectors can be separated upon removal of the coupling fastener;

the first interlock feature includes an interlock slot; and the second interlock feature includes an interlock post configured to be received in the interlock slot.

2. The disconnectable joint system of claim 1 wherein, when the first and second coupling portions are in the interlocked position, the first and second interlock features prevent relative axial displacement between the first and second coupling portions.

3. The disconnectable joint system of claim 1 wherein the coupling fastener is a shear bolt.

4. The disconnectable joint system of claim 3 wherein the shear bolt includes:

a first engagement feature to engage a first driver to enable the first driver to tighten the shear bolt onto the first and second connectors until the first engagement feature breaks off from a remaining portion of the shear bolt; and a second engagement feature to engage the first or a second driver to enable the first or second driver to remove the shear bolt from the first and second connectors, wherein the second engagement feature is part of the remaining portion.

5. The disconnectable joint system of claim 1 wherein each of the first and second connectors includes a clamping shear bolt to secure the respective cable conductor therein.

6. The disconnectable joint system of claim 1 including an electrically insulating cover configured to surround the first and second connectors, the coupling fastener, and portions of the cables.

7. A disconnectable joint assembly for disconnectably electrically and mechanically connecting first and second electrical cables each including a respective electrical conductor, the disconnectable joint assembly comprising:

a first connector defining a first conductor bore and a first coupling portion, the first conductor bore configured to receive the conductor of the first cable, the first coupling portion including:

a first coupling bore defined therein; and a first integral interlock feature;

a second connector defining a second conductor bore and a second coupling portion, the second conductor bore configured to receive the conductor of the second cable, the second coupling portion including:

a second coupling bore defined therein; and a second integral interlock feature; and a coupling fastener;

wherein:

the first and second coupling portions are mated in an interlocked position wherein the first and second interlock features are interlocked with one another and the first and second coupling bores are substantially aligned;

the coupling fastener extends through the first and second coupling bores and securely couples the first and second connectors to one another;

the first and second connectors can be separated upon removal of the coupling fastener;

the first interlock feature includes an interlock slot; and the second interlock feature includes an interlock post received in the interlock slot.

8. The disconnectable joint assembly of claim 7 wherein the first and second interlock features prevent relative axial displacement between the first and second coupling portions.

9. The disconnectable joint assembly of claim 7 wherein the coupling fastener is a shear bolt.

10. The disconnectable joint assembly of claim 7 wherein each of the first and second connectors includes a clamping shear bolt to secure the respective cable conductor therein.

11. The disconnectable joint assembly of claim 7 including an electrically insulating cover surrounding the first and second connectors, the coupling fastener, and portions of the cables.

12. A method for disconnectably electrically and mechanically connecting first and second electrical cables each including a respective electrical conductor, the method comprising:

providing a disconnectable joint assembly including:

a first connector defining a first conductor bore and a first coupling portion, the first conductor bore configured to receive the conductor of the first cable, the first coupling portion including:

a first coupling bore defined therein; and a first integral interlock feature;

a second connector defining a second conductor bore and a second coupling portion, the second conductor bore configured to receive the conductor of the second cable, the second coupling portion including:

a second coupling bore defined therein; and a second integral interlock feature; and a coupling fastener;

mating the first and second coupling portions in an interlocked position wherein the first and second interlock features are interlocked with one another and the first and second coupling bores are substantially aligned; and with the first and second coupling portions in the interlocked position, inserting the coupling fastener through the first and second coupling bores and tightening the coupling fastener to securely couple the first and second connectors to one another;

the first interlock feature includes an interlock slot;

the second interlock feature includes an interlock post; and mating the first and second coupling portions in the interlocked position includes inserting the interlock post in the interlock slot.

13. The method of claim 12 further including, after tightening the coupling fastener to securely couple the first and second connectors to one another:

removing the coupling fastener from the first and second connectors; and thereafter separating the first and second connectors from one another to electrically disconnect the first and second cables.

14. The method of claim 12 wherein, when the first and second coupling portions are in the interlocked position, the first and second interlock features prevent relative axial displacement between the first and second coupling portions.

15. The method of claim 12 wherein the coupling fastener is a shear bolt, and the method includes tightening the shear bolt on the first and second coupling portions until a head shears off from the shear bolt.

16. The method of claim 12 wherein each of the first and second connectors includes a clamping shear bolt, and the method includes tightening each clamping shear bolt onto the associated conductor until a head shears off from the clamping shear bolt.

17. The method of claim 12 including surrounding the first and second connectors, the coupling fastener, and portions of the cables with an electrically insulating cover.

* * * * *